US005624022A

United States Patent [19]

Paulson

[11] Patent Number: 5,624,022

[45] Date of Patent: Apr. 29, 1997

[54] ADJUSTABLE LIMIT FOR THE SLIDE KNOB OF SLIDE DIMMERS

[76] Inventor: Tom J. Paulson, 14721 27th Ave. NE., Seattle, Wash. 98155

[21] Appl. No.: 590,833

[22] Filed: Jan. 24, 1996

[51] Int. Cl.[6] ..... H01H 1/52

[52] U.S. Cl. ..... 200/327; 200/321; 200/43.16; 200/43.17

[58] Field of Search ..... 200/327, 321, 200/322, 43.16, 43.14, 43.19

[56] References Cited

U.S. PATENT DOCUMENTS 4,468,544 8/1984 Wainess et al. ..... 200/327

4,876,425 10/1989 Woskow ..... 200/322

4,973,801 11/1990 Frick et al. ..... 200/327

4,994,636 2/1991 Wang ..... 200/321

5,434,378 7/1995 McLean ..... 200/43.16

*Primary Examiner*—David J. Walczak

[57] ABSTRACT

A device which will limit the travel of the slide knob of a slide dimmer to a selectable value, limiting the maximum illumination level of the light bulbs that are being controlled by said dimmer.

4 Claims, 2 Drawing Sheets

ADJUSTABLE LIMIT FOR THE SLIDE KNOB OF SLIDE DIMMERS

BACKGROUND—FIELD OF INVENTION

This invention relates to adjustable limits for slide dimmers. The slide knob of the slide dimmer will be limited to a selectable maximum value anywhere along the normal travel of said slide knob, thereby limiting the maximum illumination level of the light bulbs that are controlled by said dimmer.

BACKGROUND—DESCRIPTION OF PRIOR ART

Exterior floodlights are commonly used for night lighting for security and area lighting at the exteriors of residential and commercial buildings.

The typical fixture has two weatherproof floodlights but some fixtures have one floodlight. The commercially available weatherproof floodlights are typically comprised of six choices: 150 watt incandescent, 120 watt incandescent, 90 watt halogen, 75 watt incandescent, 65 watt incandescent and 45 watt halogen, all with 2000 hour lifetime.

The typical control for these floodlights are on-off-toggle switches. A much more cost effective means of control for these light level would be to replace said on-off toggle switch with a commercially available slide dimmer and the present invention as such:

a. Instead of a 120 watt incandescent floodlight (1370 lumens output), use a 150 watt floodlight (1740 lumens) and dim it to 79 percent illumination level. The light bulbs would last 3.1 times as long.

b. Instead of a 90 watt halogen floodlight (1270 lumens), use a 150 watt floodlight (1540 lumens) and dim it to 73 percent illumination level. The light bulbs would last 4.1 times as long.

c. Instead of a 75 watt incandescent floodlight (765 lumens), use a 120 watt floodlight (1370 lumens) and dim it to 56 percent illumination level. The light bulbs would last 11.2 times as long.

d. Instead of a 65 watt incandescent floodlight (675 lumens), use a 120 watt floodlight (1370 lumens) and dim it to 49 percent illumination level. The light bulbs would last 21 times as long.

e. Instead of a 45 watt incandescent floodlight (540 lumens), use a 120 watt floodlight (1370 lumens) and dim it to 39 percent illumination level. The light bulbs would last 21 times as long.

This more cost effective control is not done because the dimmers that are available do not have a means of limiting the dimmer control to those particular values. Any set-point would be lost. The typical set-point would be "all the way up" resulting in an illumination level of 100 percent. Consequently, there would be no monetary savings or light bulb life extension. People are not aware of the monetary and other benefits of dimming higher wattage floodlights instead of using 120 watt, 90 watt, 75 watt, 65 watt or 45 watt floodlights. People presently do not have a choice because the present invention is not available to the public and the option to use 150 watt or 120 watt floodlights as substitutes for 120 watt, 90 watt, 75 watt 65 watt and 45 watt floodlights is not available to them.

Lights are on 10 hours per night. Greater or lesser use would increase or decrease annual savings in direct proportion.

The present invention would enable the user to establish a maximum setpoint of the slide dimmer, limiting its maximum setpoint to any point over its continuous range, thereby enabling the user to realize monetary savings and light bulb life extension. The settings could be made in any of these ways:

a. Place a light meter in the center of the floodlight's area of illumination and record the reading. Determine the ratio of the floodlight that is to be replaced to that which will be used (150 watt or 120 watt) and multiply the recorded illumination level by that ratio. Then, adjust the dimmer until that illumination level is observed. Finally, slide the limit arm against the dimmer slide knob and tighten the set screws. Now, the maximum illumination level is set at the correct value to produce the light level of the floodlight that is chosen to be replaced.

b. Maximum travel is 100 percent illumination and minimum travel is zero percent illumination. The percentage output can be approximated by interpolation between these two limits. As above, slide the limit arm against the slide knob and tighten the set screws.

c. A visual check can be make to reduce the level to be say 55 percent or to some other level as desired. Then set the limit arm as above. The benefits will not be as quantifiable as a or b above, but nonetheless they will be there.

OBJECTS AND ADVANTAGED

Accordingly, besides the objects and advantages of the adjustable limit for the slide knob of slide dimmers described in my above patent, several objects and advantages of the present invention are:

(a) To provide a means to establish a maximum setpoint of a slide dimmer, limiting the maximum setpoint to any point over its continuous range, thereby limiting the illumination level of the light bulb that is being controlled, with these resultant benefits:

2. The user could increase the life of the light bulb by up to 20 times with these resultant benefits:

a. Less time and energy to be spent on shopping and installation.

b. Installation in many cases are in difficult locations, high on exterior walls and may require a ladder.

c. Security and reliability would increase. The probability that a light bulb would extinguish when the user is on vacation or asleep would be reduced by up to 95 percent.

Further objects and advantages are to provide an adjustable limit for the slide knob of slide dimmers which is inexpensive to manufacture and inexpensive to the user. Still further objects and advantages will become apparent from a consideration of the ensuing description and drawings.

DRAWING FIGURES

DETAILED DESCRIPTION OF THE PREFERRED EMBODIMENT

Figure 1:
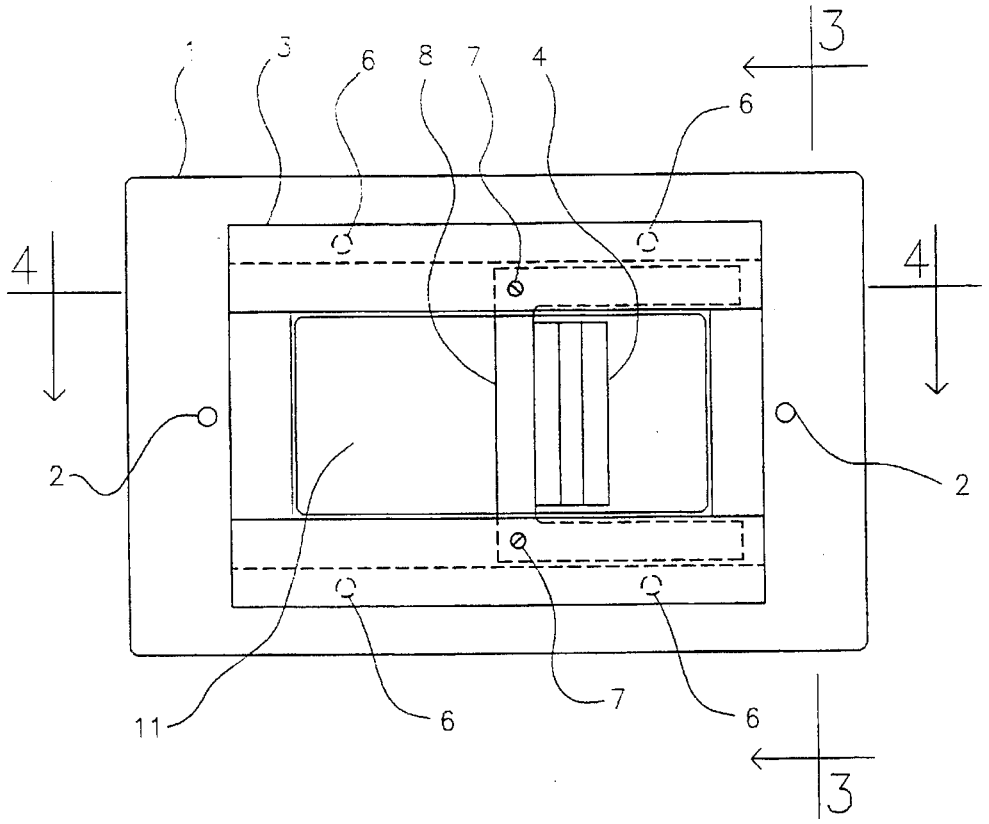
FIG. 1 is a plan view of the mechanical device of the present invention shown attached to a wallplate. Both are shown atop the slide dimmer with the slide knob shown in its position for zero percent illumination level.

Referring now to FIG. 1, it can be seen that an adjustable limit for the slide knob of slide dimmers in accordance with the present invention comprises a unitized body 3 that is attached to the slide dimmer wallplate 1 by means of screws 6. 2 are the holes for the screws which attach said wallplate to the electrical wallbox. The front of the slide dimmer 11 can be seen through the slide dimmer wallplate opening. The slide knob 4 of the dimmer is shown in its position of 100 percent dimming or zero percent illumination. The limit arm 8 is contained within slots and said bracket can move freely in the direction of movement of said slide control knob. When the slide knob maximum limit of travel is determined, said limit arm can be butted up against said slide knob. The set screws 7 are tightened, thereby limiting the upper travel of said slide knob to that selected value. The maximum level of illumination of the light bulbs will correspond to that maximum position of said slide knob. Importantly, the maximum level of illumination can be set at any level from zero percent to 100 percent.

Figure 2:
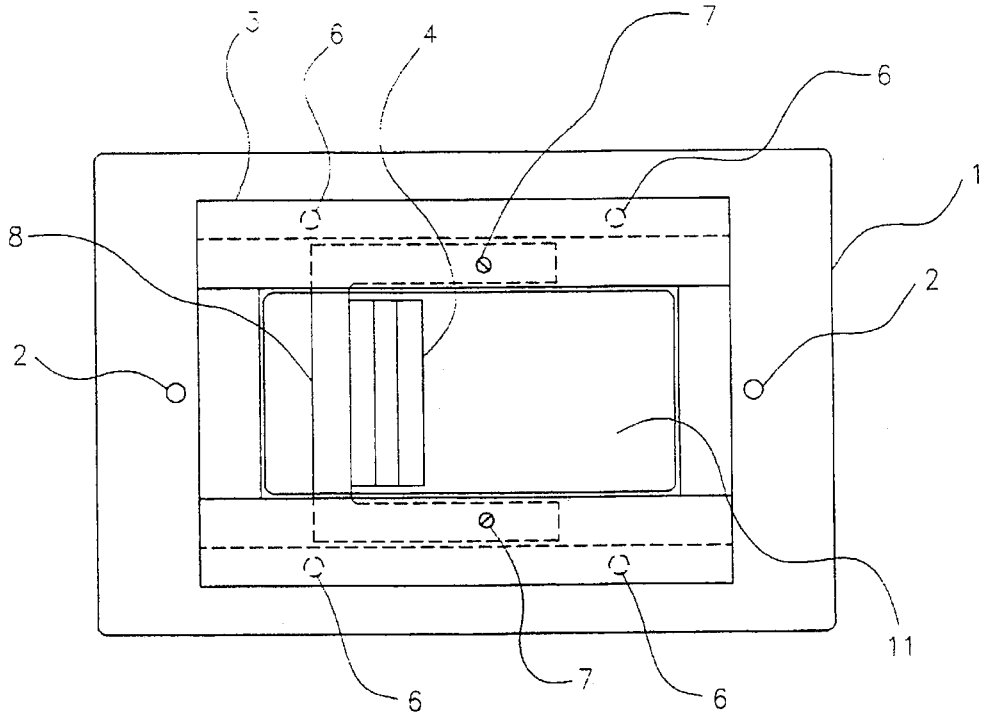
FIG. 2 is a plan view of said mechanical device shown attached to a wallplate. In this view, the dimmer slide knob is shown in its position for 100 percent illumination level.

Referring now to FIG. 2, the slide knob 4 of the dimmer is shown in its position of zero percent dimming or 100 percent illumination. The limit arm 8 is shown butted up against said slide knob. Importantly, said limit arm can be butted up against said slide knob over the entire range of travel of said slide knob. Then, the set screws 7 can be tightened to secure said limit arm and limit its travel to that position.

Figure 3:
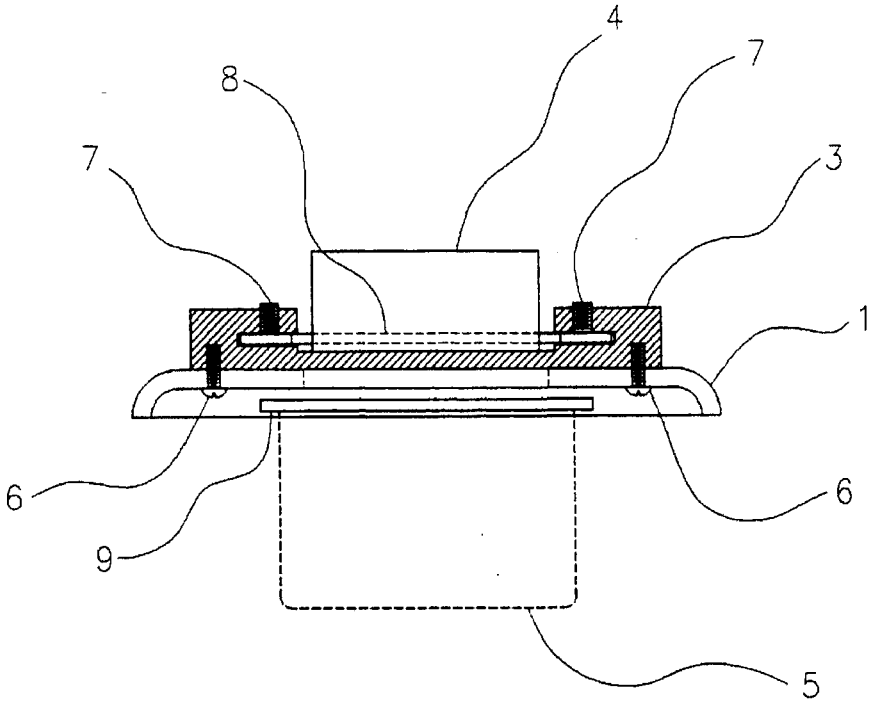
FIG. 3 is a section showing said mechanical device attached to the wallplate. The slide dimmer is also shown.

Referring now to FIG. 3, the unitized body 3 is seen to be attached to the slide dimmer wallplate 1 by means of screws 6. 5 is the outline of the dimmer body. Said dimmer body is contained within an electrical wallbox not shown. 9 is the bracket of said dimmer which is in secured to the electrical wallbox by screws, not shown in its normal manner. 4 is the slide knob. The limit arm 8 is shown behind said slide knob and the set screws 7 can be tightened to secure said limit arm at any position along the normal range of travel of said slide knob. Said limit arm is seen contained within the slots of the body of the device.

Figure 4:
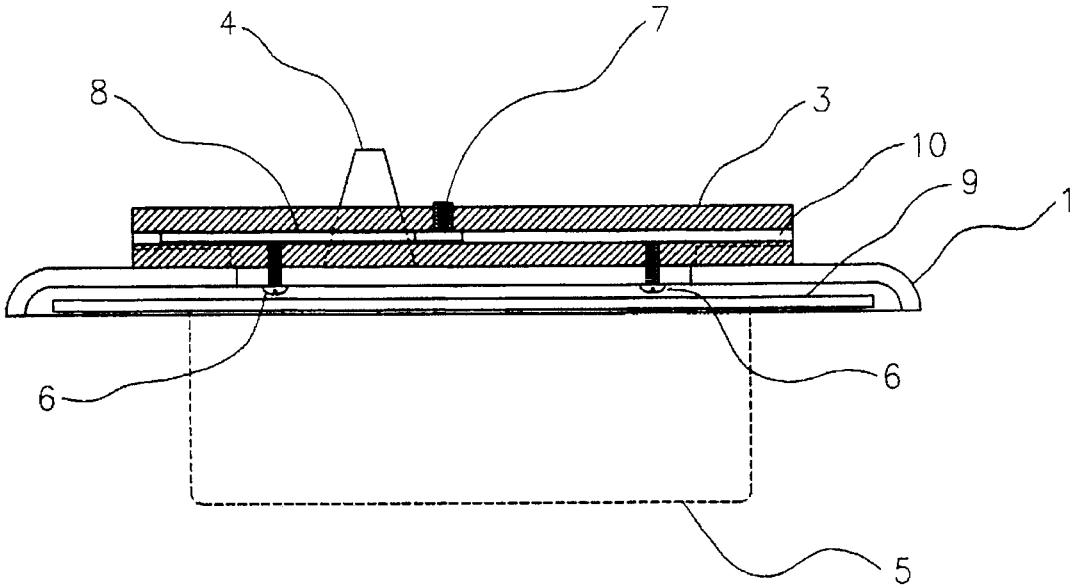
FIG. 4 is a section showing said mechanical device attached to the wallplate. The slide dimmer is also shown.

Referring now to FIG. 4, the slide knob 4 is shown in its position of 100 percent dimming or zero percent illumination. The limit arm 8 is shown butted up against said slide knob. Said limit arm is contained inside the slots 10 and said limit arm may slide within the slots until it is secured when the set screws 7 are tightened.

SUMMARY, RAMIFICATIONS AND SCOPE

Accordingly, the reader will see that the adjustable limit for the slide knob of slide dimmers of this invention can be used to limit the setting of the dimmer slide knob to a selectable set point. That set point can be anywhere along the normal range of the travel of said slide knob. That set point will limit the maximum value of illumination of the light bulbs by limiting the percent of dimming. Furthermore, the adjustable limit for the slide knob of slide dimmers has the additional advantages in that:

It allows for setting the maximum illumination level for the light bulbs at any selected point from zero to 100 percent.

The set point is maintained by a limit which can be secured at any point by the use of set screws. To change that setting would require the use of a tool.

Resultant light bulb life can increase by up to 20 times the life of a light bulb that is illuminated at 100 percent.

Security and reliability would increase. The probability that a light bulbs would extinguish when the user is on vacation or asleep would be reduced by up to 95 percent.

Less time and energy would be spent on shopping for replacement light bulbs.

Because lamp changes would decrease by up to 95 percent, the difficult installations that are often the case with exterior floodlighting would also be reduced by up to 95 percent.

The present invention is especially suited to control exterior floodlights. The selection of floodlight types will be reduced from six to two: 150 watt incandescent and 120 watt incandescent Without the present invention, any set point of a slide dimmer would be lost. The normal tendency is to run the slide knob up to its maximum travel which is 100 percent illumination. The present invention is unavailable to the public but this invention will allow the public to realize all of the benefits outlined in this section of this specification.

Although the description above contains many specificities, these should not be construed as limiting the scope of the invention but as merely providing illustrations of some of the presently preferred embodiments of this invention. Thus the scope of the invention should be determined by the appended claims and their legal equivalents, rather than by the examples given.

I claim:

1. A device for limiting travel of a slide knob of a slide switch comprising:

a wall plate adapted to be attached to the switch and having an opening therethrough for receiving the slide knob when the wall plate is attached to the switch;

a body member attached to a front face of the wall plate wherein the body member includes a central opening adapted to enable the slide knob to protrude therethrough when said body member is attached the wall plate and a pair of sidewalls positioned on opposite sides of the slide knob when said body member is attached to the wall plate;

an elongated slit located in each of said side walls; and a limit arm slidably positioned in said slits and extending across said central opening and lockable into one of a plurality of selected position within said slits by a locking means whereby the slide knob is adapted to abut said limit arm when said limit arm is locked in a selected position to thereby selectively limit the travel of the slide knob.

2. The device as claimed in claim 1 wherein said body member is attached to the wall plate with at least one screw.

3. The device as claimed in claim 1 wherein said locking means comprises at least one set screw positioned in said body member for lockably contacting said limit arm.

4. The device as claimed in claim 1 wherein said body member is a one-piece unit.

* * * * *